United States Patent [19]

Hollstein et al.

[11] 4,248,379

[45] Feb. 3, 1981

[54] POWDER SPRAY COLOR CHANGE SYSTEM

[75] Inventors: Thomas E. Hollstein, Amherst; Gerald W. Crum, Elyria, both of Ohio; Louis A. Frey, Greensboro, N.C.

[73] Assignee: Nordson Corporation, Amherst, Ohio

[21] Appl. No.: 67,185

[22] Filed: Aug. 16, 1979

[51] Int. Cl.[3] ..... B05B 15/02

[52] U.S. Cl. ..... 239/1; 239/8; 239/704; 239/113; 239/305

[58] Field of Search ..... 222/148; 239/1, 3, 8, 239/690, 697, 698, 704, 112, 113, 305, 307, 325; 241/166; 118/302, 652; 137/238

[56] References Cited

U.S. PATENT DOCUMENTS

| | | | |
|---|---|---|---|
| 3,375,032 | 3/1968 | Frantz | 239/113 X |
| 3,667,674 | 6/1972 | Parsons et al. | 239/698 |
| 3,746,254 | 7/1973 | Duncan et al. | 239/697 |
| 3,782,632 | 1/1974 | Braun et al. | 239/112 |
| 3,873,024 | 3/1975 | Probst et al. | 239/697 X |

*Primary Examiner*—Andres Kashnikow
*Attorney, Agent, or Firm*—Wood, Herron & Evans

[57] ABSTRACT

An electrostatic powder coating system for selectively spraying any one of a plurality of different pulverant powder materials from a common spray gun without the necessity for physically disconnecting or reconnecting the spray source of the different pulverant materials to the common gun. This system includes the common spray gun, a plurality of powder material reservoirs and associated venturi pumps connected to a common manifold block. That manifold block is also connected to a source of purging air flow. Internally of the manifold block there are pinch valves operable to selectively connect and disconnect each of the different powder material reservoirs and the purging air flow to the common spray gun. Additional pinch valves separate the material reservoirs from the venturi pumps associated with each reservoir. The various pinch valves, purging air and pump air flows are sequenced such that changes from one powder to another are effected in a very short time duration without the contamination of any new powder with any residual powder from a previous cycle a... without the occurrence of any puffing or unusually heavy flows of powder at the beginning or end of a spray cycle.

13 Claims, 2 Drawing Figures

POWDER SPRAY COLOR CHANGE SYSTEM

The present invention relates generally to an electrostatic spray system for spraying pulverant or so-called powder materials onto an article to be coated. More specifically, the present invention relates to an improved electrostatic powder coating system including apparatus for quickly changing from one type or color pulverant material sprayed from the gun to another material or color without the requirement of physically disconnecting and reconnecting the powder sources to the common spray gun.

At the present time the spraying of various color powder materials is done largely with separate spray guns, one for each color, or with one gun that is adapted for rapid connection and disconnection to hoses carrying separate colors or materials or powder. U.S. Pat. No. 3,667,674 illustrates such a quick disconnect system. Attempts have been made to provide a remotely controlled apparatus which will feed different colors to a single spray gun and which permit the operator to clean the spray gun by passing a purging air flow through it as a part of the color change cycle. U.S. Pat. No. 3,873,024 is typical of such a system.

In many applications, such as the painting of automobile parts, it is desirable that a color powder spray system be fast enough to complete a color change in the interval between the passage of successive articles hung from a conveyer traveling at a normal speed. This time interval may amount to only a few seconds. Further, the change from one color to another, including the purge of the old color before start-up of the new, must occur not only quickly but without a "puff" of excessively heavy flow or cloud of powder material at the start or end of a cycle. Any such puff is undesirable because it results in excessively heavy concentration of coating material on one particular portion of the object to be coated. Furthermore, the color change must occur without any contamination of the new powder with any residual powder left in the system from any previous spray cycle.

The invention of this application accomplishes the objective of effecting a quick powder change from one color or characteristic powder to another without the occurrence of puffing at the beginning or end of a spray cycle and without the contamination of any new powder with any previously cycled powder. To accomplish these objectives this invention includes multiple fluidizing bed reservoirs within which there are stored different powder material. These different powder materials are selectively drawn into the system via venturi pumps associated with each of the reservoirs and connected thereto via a pinch valve. Each of the venturi pumps is connected via an air flow conveyer or a conduit to a common manifold, which manifold has multiple inlets connected to a common passageway internally of the manifold. This common passage is connected at one end to a source of purge air flow and at the opposite end to the common spray gun. Each of the inlet ports of the manifold block may be successively connected to disconnected from the common flow passageway via pinch valves located at each of the inlet ports of the manifold block. The pinch valves are cycled so as to effect a quick and yet efficient color change without the occurrence of any puffing or excessively heavy flow of powder during or at the end of a spray cycle.

One aspect of this invention is predicated upon the construction of the common manifold to which all of the powder reservoirs are connected by conveyer conduits. This manifold contains a central passageway connected at one end to purging air flow and connected at the opposite end or exit end to the powder spray gun via a powder conveyer conduit. The central passageway is intersected by a plurality of transverse passageways, each of which is connected to one of the powder reservoirs via a conveyor conduit. Each transverse passage contains a flow controlling pinch valve and each intersects the central passageway at an obtuse angle generally directed at the exit end of the central passageway. These transverse passageways enter into the central passageway from opposite sides but are staggered longitudinally of the central passageway so that flow from one transverse passage is not directed into a transverse passage on the opposite sides of the central passageway. This staggered construction enables the manifold to be substantially shortened in length as compared to a manifold in which all transverse passages enter the central passage from the same side.

Applicants have also discovered, and still another aspect of this invention is predicated upon the discovery that if a pinch valve associated with each of the venturi pumps of a reservoir is opened either simultaneously or subsequent to the start-up of air flow through the associated venturi pump, and if that same pinch valve is closed either simultaneously with or prior to the termination of air flow to the associated venturi pump, puffing which customarily occurs at the beginning of a spray cycle may be avoided.

Still another aspect of this invention is predicated upon a discovery of a more efficient technique for purging powder from a powder spray system. Specifically, applicants have discovered that the efficiency of an air purge may be markedly increased without the occurrence of puffing of powder being blown through the gun at excessively high velocities if the air purge is first initiated at a relatively low steady pressure, as for example the pressure at which the system customarily sprays powder and is then subsequently increased in pressure and pulsed to blow the last remnants of powder from the system. In the preferred practice of this aspect of the invention, applicants have found that the cleaning efficiency is increased and objectionable puffing avoided by initiating the air purge at approximately 10–15 psi then subsequently, after most of the residual material has been blown from the gun, increasing the pressure to a pulsating 60 psi. This purging air flow sequence results in a complete purge of all residual powder from the system without the occurrence of an objectionable puff of powder at the beginning of the purge cycle and without the occurrence of an objectionable high velocity stream of powder being shot from the gun.

Other aspects, objectives and advantages of this invention will be more readily apparent from the following description of the drawings in which.

Figure 1:
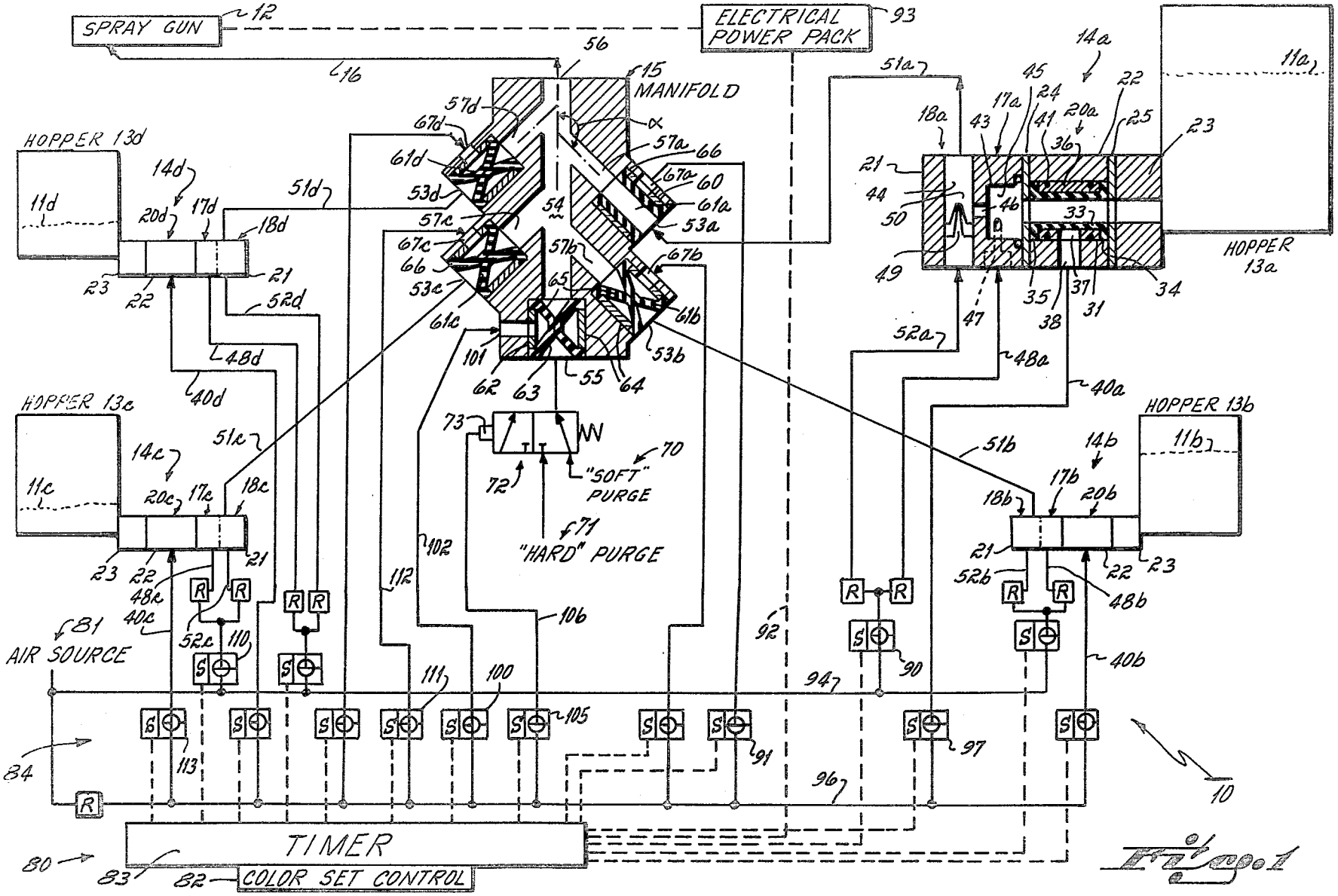
FIG. 1 is a diagrammatic illustration of a complete color change system incorporating the invention of this application.

With reference to FIG. 1 there is illustrated a color change powder spray system 10 for selectively spraying any one of four different color powders 11*a*, 11*b*, 11*c* and 11*d* from a single common spray gun 12. While the system is illustrated as being applicable to spray any one of four different colors, the number of colors is of course a matter of choice. Additionally, rather than spraying different color powders the system may be used to spray powders differing in physical characteristics other than color. In most applications though the different powders will vary in color since that is the characteristic most commonly changed in a multi powder spray system.

The four different powders 11*a*, 11*b*, 11*c* and 11*d* are contained in four different fluidized bed hoppers 13*a*, 13*b*, 13*c* and 13*d*. The powder in these hoppers is maintained entrained in air as a consequence of air injected into the hopper via a conventional fluidized bed (not shown) located within each hopper.

In addition to the four fluidized bed hoppers, and the single spray gun 12, the system comprises four different powder pumps 14*a*, 14*b*, 14*c* and 14*d* associated with each of the fluidized bed hoppers 13*a–d*. Each powder pump is operative to convey powder while entrained in air from one of the fluidized bed hoppers to a common color change manifold 15. From this manifold 15 powder is transported via a conduit 16 to the spray gun 12.

Each powder pump 14*a–d* comprises a diffuser section 17*a–d*, a venturi pump section 18*a–d*, and a pinch valve section 20*a–d*. The pinch valve sections each include a pinch valve sleeve which, as explained more fully hereinafter, controls the flow of fluidized powder from the fluidized bed reservoirs 13*a–d* to the pumps 14*a–d*. By locating the diffusers between the pinch valves and the pumps, the flow of powder from the pump and the distribution of the powder in the air stream is maintained smooth and even.

POWDER PUMPS

For each different color powder or different powder material there is a separate powder pump. In the four color system illustrated in FIG. 1, there are four powder pumps 14*a*, 15*b*, 14*c*, 14*d*. Each of the powder pumps 14*a*, 14*b*, 14*c* and 14*d* comprises three different stacked manifold blocks 21, 22 and 23. The first of these three manifold blocks, the powder pump manifold block 21, houses one of the powder pumps 18*a–d* and one of the associated powder diffusers 17*a–d*. The second block 22 contains a pinch valve 20*a–d* operable to control flow of powder to the associated pump and the third block, connector block 23, contains the powder flow passage which supplies powder to the associated pinch valve. Each set of three blocks 21, 22, 23 are separated by a pair of flat plates 24, 25. The blocks and plates 24, 25 are maintained in an assembled airtight stack by studs (not shown) which extend through aligned bores of the three blocks 21, 22, 23 and the pair of plates 24, 25. The connector block 23 connects the pinch valve block 22 to the fluidized bed 11 of hopper 13.

Mounted within each of the bores 31 of each of the pinch valve manifold blocks 22 is a conventional pinch valve 20*a–d*. This pinch valve comprises a resilient sleeve 33 having radial flanges 34, 35 on its opposite ends. Between the flanges there is located a metal sleeve 36 through which extend radial ports 37. At least one of these ports 37, of each sleeve, communicates with a radial port 38 of the manifold block which is connected to a pinch valve actuating air line 40*a–d*. In each valve, the axial bore 31 is sealed against the escape of air around the exterior of the pinch valve by a pair of O-rings 41 mounted within annular grooves in the exterior of the metal sleeve 36.

Each powder pump manifold block 21 has a stepped axial bore 43 which intersects a radial venturi pump passage 44. The axial bore 43 comprises a large diameter dispersion chamber 45 interconnected by a smaller diameter section 46 to the radial bore 44. Radial passageway 47 communicates with the dispersion chamber 45 and is connected to a source of air pressure via one of the diffuser air lines 48*a–d*.

Each of the venturi pump passages 44 (only one of which is illustrated in FIG. 1) contains an air jet nozzle 49 having a large diameter entrance way and a small diameter exit. When air is directed through the nozzle it is operative to create a low pressure zone around the exterior of the exit which is in turn operative to draw or suck powder from the dispersion chamber 45 into the low pressure zone 50 of the venturi pump from which it is caused to flow through its respective powder flow line 51*a–d* to the color changer manifold 15. Air is supplied to the inlet side of each nozzle 49 via an ejector air line 52*a–d*.

The venturi pump including the nozzle 49 for pumping or causing powder to be suctioned from a source of powder into the venturi pump and then flowed while entrained in air to a powder spray gun is well-known in the powder spray art and has not therefore been illustrated or described in detail herein. A more complete description of such a venturi pump may be found in U.S. Pat. No. 3,746,254.

In practice, flow of powder from any of the fluidized powder reservoirs 13*a–d* to the four venturi pumps is controlled via one of the four pinch valves 20*a–d*. When powder is to be supplied from a selected one of the powder reservoirs 13*a–d* to the venturi pump 44 associated with that reservoir, the supply of air pressure to that pinch valve via the pinch valve actuating air line 40*a–d* is cut off so that the line 40 is open to atmospheric pressure. This results in the pinch valve opening. The pinch valve is only opened simultaneously with or after air flow is initiated via the lines 48*a–d* and 52*a–d* to the diffuser and venturi pump associated with a selected pinch valve 20*a–d*. This sequence of opening the pinch valve only simultaneously with or after initiating air flow through the associated venturi pump is important to prevent puffing of powder upon initial start-up of flow from the pump to the gun. If the pinch valve is first opened and flow through the venturi pump subsequently initiated, applicants have found that there is a resulting undesirable heavy flow or puff of powder at the start-up of spray from the gun. This heavy start-up flow or puff results in an undesirably heavy deposit of powder over that portion of the target which is in front of the gun at the start-up. But, by sequencing the pinch valve so that it only opens after air flow through the venturi pump is initiated, or simultaneously therewith, this initial heavy burst or puff is avoided.

When a pinch valve 20 is opened, air will flow from a respective ejector air line 52*a–d* through a venturi pump 44. Thus, powder is drawn from a fluidized powder reservoir 13*a–d* through a pinch valve 20 and through the associated diffuser 45 into a powder flow line 51*a–d* which connects that venturi pump to the color changer manifold 15. Simultaneously with the flow of ejector air in an ejector air line 52*a–d*, flow is initiated via a diffuser air line 48*a–d* to the associated diffuser chamber 45. This air flow into the diffuser chamber has the effect of creating a better dispersion of powder in air before the powder is drawn into the venturi pump. Consequently, the diffuser is effective to make the powder flow more even than it otherwise would be absent the diffusion air chamber.

COLOR CHANGE MANIFOLD

Each of the outlets of the powder pumps 14*a–d* is connected via a powder flow conduit 51*a–d* or conveyor to respective inlet ports 53*a–d* of the color change manifold 15. This manifold has a central axial passageway 54 extending therethrough from an air purge inlet port 55 to a spray gun outlet port 56. Four different lateral passageways 57*a–d* connect the central passageway 54 to one of the inlet ports 53*a–d*. These lateral passageways 57*a–d* intersect the central passageway at an angle $\alpha$ of 135° such that powder flowing from any one of the lateral passageways 57*a–d* into and through the central passageway 54 need only be changed in direction through a relatively slight angle in order to convert its lateral flow through the passageways 57*a–d* into axial flow through the passageway 54.

Each of the inlet ports 53*a–d* of the color changer manifold 15 is bored to provide the lateral passageways 57*a–d* with an enlarged diameter end section 60 for the reception of a pinch valve 61*a–d*. Similarly, the inlet port 55 is counterbored to provide an enlarged end section 62 at the inlet end of the central passage 54 in the manifold block. A pinch valve 63 is mounted in the enlarged bore 62.

Each of the pinch valves 61*a–d* and 63 of the color changer manifold 15 comprises a metal sleeve 64 internally of which there is mounted a resilient flexible hose or sleeve 65. This flexible hose 65 has radial flanges 66 extending laterally from the ends of the hose and secured to the ends of the metal sleeve 64. This metal sleeve 64 is ported and has at least one of the ports in registry with a respective pinch valve control port 67*a–d* of the manifold block such that when air pressure is injected into a port 67*a–d* it will cause the hose 65 to be flexed inwardly. This control pressure injected into the pinch valve through an inlet port 67*a–d* causes the pinch valve to be collapsed and thereby to block or close all flow through the pinch valve.

Flow of purging air to the inlet port 55 of the color change manifold 15 is derived from either one of two sources 70, 71 through a pneumatically operated three-way valve 72. When the pneumatic actuator 73 of this valve is deenergized, low pressure "soft purge" air pressure at approximately 15 psi is supplied through valve 72 to inlet port 55. When the pneumatic actuator 73 is energized, the three-way valve connects a high pressure source 71 of pulsating air, as for example air at a pressure which pulsates between 0 and 60 psi at a frequency of once per second to the inlet port 55 via the valve 72.

SYSTEM OPERATION

In operation, the flow of fluidized powder from any one of the four fluidized powder hoppers 13*a–d* is controlled by an electrical control module 80 which controls the flow of air from a source of air pressure 81 to the powder pumps, the fluidized bed hoppers, and the pinch valves of the color changer manifold 15. By controlling the flow of air to these pinch valves and to the powder pumps, the control module is operative to control which of the four different powders is sprayed from the gun 12.

The control module 80 comprises a color set control section 82 which may be any conventional form of programmed or even non-programmed manual color selector and a timer section 83. This control module controls actuation of solenoid valves of a solenoid valve section 84. The color set control 82 and timer 83 are operative to actuate the electrical solenoids of the solenoid valves in any desired sequence to effect a particular color spray cycle. The operation of this cycle may best be understood with reference to a color change sequence of operation.

For purposes of illustration the operation of the system will be described in a spray cycle in which a first color powder 11*a* from hopper 13*a* is sprayed from spray gun 12 and then a second powder 11*c* from hopper 13*c* is sprayed through the same spray gun 12. The color change sequence, i.e., from hopper 13*a* and then from hopper 13*c* may be either programmed into the color set control 82 or may be manually selected at the color set control 82 by an operator watching parts move before the spray gun 12. In either event, the electrical circuitry required to effect the color change by either a programmed or manual command is conventional and except for the timing, forms no part of this invention.

Figure 2:
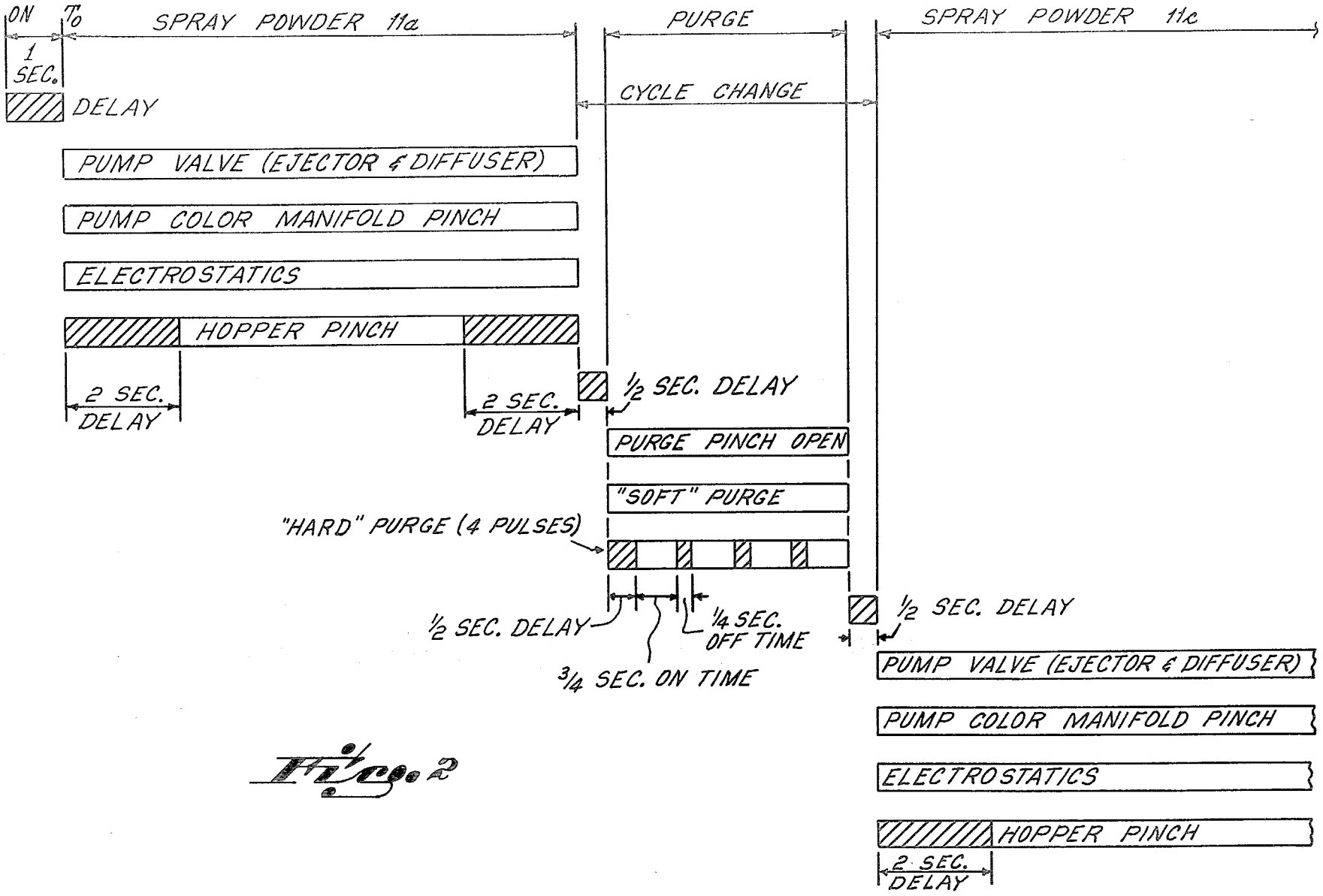
FIG. 2 is a timing chart illustrating a flow control cycle employed in the system of FIG. 1.

Referring to FIG. 2 there is illustrated a timing chart for effecting a color change cycle. Specifically, as illustrated in this chart, upon initiation of a color spray cycle by selection of a color at the color set control, there is approximately a one second delay before any of the solenoids or solenoid valves contained in the solenoid valve bank 84 are actuated. Selection of the powder 11*a* results in the solenoid valves 90, 91 being electrically energized and simultaneously the circuit 92 to the high voltage power pack 93 being actuated. Energization of the solenoid 91 results in the opening of pinch valve 61*a*. Energization of the solenoid valve 90 has the effect of opening the air spray line 94 from the air source 81 to the air lines 52*a* and 48*a*. Air line 52*a* is the ejector air line which supplies air to the venturi pump 18*a* and air line 48*a* is the diffuser air line which supplies air to the dispersion chamber 45 of diffuser section 17*a*. Thus, initially air is caused to flow through the venturi pump and diffuser but the pinch valve 20*a* is at this time closed by high pressure air from air line 96 flowing through non-energized solenoid valve 97 to pinch valve air line 40*a*.

After approximately a two second delay following the energization of the solenoid valves 90, 91, the solenoid of hopper pinch valve 97 is energized. This has the effect of closing air line 96 to pinch valve air line 40*a* and of opening line 40*a* to atmospheric pressure. Opening of this air line to atmospheric pressure results in the resilient sleeve 33 returning to its relaxed condition in which its bore is open and free for the flow of powder from the fluidized bed hopper 13*a* through the pinch valve and diffuser into the suction zone 50 of the venturi pump 18*a*. The venturi pump 18*a* is then effective to cause air entrained powder to flow through line 51*a* and now open pinch valve 61*a* to conveyor line 16 and subsequently to the spray gun 12. Powder flowing through the spray gun 12 is electrostatically charged by passage through an electrical field created at the gun by the power pack 93.

Because the pump 18*a* is opened after approximately a two second delay following energization of the solenoid valves 90, 91, air flows through the venturi pump and diffuser before the arrival of powder at the venturi pump. Applicants have found that by delaying the supply of powder to the venturi pump until after a steady flow of air is flowing through the pump, the problem of initiating powder flow from the gun with a heavy initial "puff" or burst of powder is avoided.

When it is desired to terminate the flow of powder 11*a* from hopper 13*a* to the spray gun, the cycle is initiated at the color set control by causing the solenoid of valve 97 to be deenergized, thereby again connecting pinch valve supply line 40*a* to high pressure air line 96. This has the effect of connecting air pressure above atmospheric pressure to the pinch valve port 38, thereby causing the resilient sleeve 33 of the pinch valve to be collapsed and closed. Approximately two seconds after pinch valve 20*a* is closed, the solenoids of valves 90, 91 are deenergized and the flow of electrical power to lead 92 is cut off. This two second delay enables all powder in the venturi pump 18*a* and the powder conduit 51*a*, as well as in the pinch valve 61*a* of the color manifold, to be evacuated before initiation of a color change sequence. Thereby residual powder is not left in the venturi pump 18*a* or the color change manifold supply line to create a subsequent puffing problem upon start-up of the next cycle involving the selection of powder 11*a* to be sprayed from the gun 12.

After deenergization of the valves 90, 91 and consequent termination of air flow through the diffuser 17*a* and venturi pump 18*a* and closing of the pinch valve 61*a*, there is a one-half second delay before the air purging cycle is initiated. This one-half second delay insures that the pinch valve 61*a* is completely closed before an air purging cycle is initiated.

After the one-half second delay the purge cycle is initiated by energization of the solenoid of purge valve 100. Energization of this solenoid has the effect of opening control port 101 of the pinch valve 63 to atmospheric pressure and disconnecting it from air line 96. Connection of this port 101 with atmospheric pressure results in the pinch valve 63 opening, thereby opening the central passageway 54 of the color change manifold to the supply of "soft" purge air at a pressure of approximately 15 psi from a source of air pressure 70. Generally powder is conveyed through this system and through the gun 12 at a pressure on the order of 5–10 psi. The pressure of air from the source 70 is maintained slightly above that pressure but not so far above as to generate excessive velocity to powder forced through the system by this "soft" air purge. After the "soft" purge has been on for approximately one-half second, "hard" purge is initiated to physically drive any residual powder from the color change manifold 15, the air line 16, and the spray gun 12. This hard purge is initiated by actuation of the solenoid valve 105. Energization of this solenoid has the effect of connecting a pneumatic actuator 73 of the three-way valve 72 to the air line 96 via line 106. This actuation of the three-way valve 72 causes pulsing high pressure air from a source 71 to flow through the three-way valve 72 to the inlet port 55 of pinch valve 63 and subsequently through the central passageway 54 of the color change manifold. This high pressure pulsating air flow then flows through air line 16 and gun 12. As may be seen in FIG. 2, high pressure pulsating air flow is pulsed at the rate of one cycle per second with air flow being on at 60 psi for three-fourths of a second and then off at zero psi for one-fourth of a second. Preferably the cycle is repeated through four pulses or for approximately four seconds before both solenoid valves 100, 105 are deenergized. Deenergization of the solenoid valve 105 has the effect of reconnecting the soft air purge 70 to the inlet port 55 of the pinch valve 63 and deenergization of valve 100 has the effect of reconnecting the control port 101 of the valve to air line 96 via line 102, thereby again closing pinch valve 63. Low or soft air pressure is maintained to the inlet port 55 of valve 63 even after the valve is closed, but this has no effect on the color change manifold so long as the pinch valve 63 is maintained in the closed position.

The timer 83 is then operative to maintain a one-half second delay before initiation of a new spray cycle. To initiate the flow of a new powder 13*c* to the spray gun 12, the solenoid valves 110 and 111 are energized. Energization of solenoid valve 110 results in air flow from line 94 being connected to the ejector and diffuser air lines 52*c* and 48*c* with the result that air flow is initiated to the venturi pump 18*c* and the diffuser 17*c*. Energization of the solenoid valve 111 results in the connection of the control port 53*c* of pinch valve 61*c* to atmospheric pressure via air line 112. The pinch valve 61*c* is thereby opened. Approximately two seconds after energization of the solenoids of solenoid valves 110, 111 the solenoid of solenoid valve 113 is energized, thereby connecting pinch valve control air line 40*c* to atmospheric pressure through solenoid valve 113. Opening of the pinch valve 20*c* causes powder 11*c* to be drawn from the hopper 13*c* into the venturi pump 18*c* and subsequently supplied through the color change manifold 15 to the spray gun 12.

In practice we have found that a complete color change can be effected by using the system described hereinabove in approximately six seconds. We have also found that the air purge sequence described hereinabove, with its initial "soft" and subsequent "hard" pulsating air purge, is very effective to remove all traces of one powder from the system before initiation of a new powder flow through the system just six seconds later. Additionally, this system has the advantage of eliminating the puff or excessive powder flow which has traditionally characterized start-up flow of powder from any powder spray system.

While we have described only a single preferred embodiment of our invention, persons skilled in this art will appreciate numerous changes which may be made without departing from the spirit of our invention. Therefore, we do not intend to be limited except by the scope of the following appended claims.

Having described our invention we claim:

1. The method of purging a powder from a pulverant powder coating system prior to initiation of a spray cycle through the system utilizing a new powder, which method comprises directing non powder entrained air through the system at a first pressure near the pressure at which powder entrained air is customarily directed through the system, and subsequently increasing the pressure at which the non powder entrained air is directed through the system to a second pressure is at least double that of the first pressure, and pulsing the flow of non powder entrained air through the system at said second pressure.

2. The method of purging powder from a pulverant powder coating system prior to initiation of a spray cycle through the system utilizing a new powder, which method comprises directing non powder entrained air through the system at a first low pressure, and subsequently directing non powder entrained air at a second pressure which is at least twice that of the first low pressure, and pulsing the flow of non powder entrained air through the system at said second pressure.

3. The method of claim 2 in which said first low pressure air is directed through the system at a steady flow rate.

4. The method of claim 2 in which the pressure at which said second high pressure air is directed through the system is at least four times as great as the pressure of said low pressure air.

5. The method of claim 2 in which said non powder entrained air is directed through said system at a first low pressure of approximately 15 pounds per square inch and is then subsequently pulsed through the system at a pressure of approximately 60 pounds per square inch.

6. The method of operating a multiple color electrostatic powder spray system so as to change from one color powder ejected from the system to another color, which method comprises, spraying a first color powder material from a first reservoir through a reservoir pump and a common manifold block to a common spray gun, cutting off the flow of powder from said first reservoir to said reservoir associated pump while continuing to operate said reservoir associated pump for at least one second, directing a first low pressure purge flow of air through said common manifold and through said common spray gun, subsequently directing a hard purge of high pressure air in a pulsed flow through said common manifold and common spray gun, initiating the flow of air through a second pump associated with a second powder reservoir, opening the flow of powder material from said second reservoir to said second pump simultaneously with or subsequent to initiating the flow of air through said second pump.

7. An electrostatic powder coating system for selectively spraying any one of a plurality of different pulverant powder materials from a common spray gun, which system comprises a spray gun having a spray material flow passage terminating in an outlet orifice, means including a high voltage power supply for applying an electrical charge to powder material emitted from said spray gun, a plurality of powder material reservoirs, a manifold block having multiple powder inlet ports, an outlet port, and flow passages interconnecting said powder inlet ports to said outlet port, first conduit means connecting each of said plurality of powder material reservoirs to one of said inlet ports of said manifold block, second conduit means connecting said outlet port of said manifold block to said flow passage of said spray gun, multiple pinch valve means located in the manifold block flow passages and operable to control the flow of powder from each of said powder inlet ports to said outlet port, an air purge inlet connected to said manifold outlet through said manifold flow passages, a source of air pressure connected to said air purge inlet so as to enable said spray gun and second conduit means to be purged of powder before initiation of a spray cycle of a new powder, said source of air pressure including supply means for initially supplying air at a first low pressure to said purge air inlet of said manifold block and for thereafter increasing the pressure of air supplied to said purge air inlet to a subsequent high pressure at least twice as great as the initial low pressure, and control means for selectively activating said pinch valve means to control the choice of powder flowing to said outlet of said manifold and consequently to said spray gun.

8. The electrostatic powder spray system of claim 7 in which said air pressure supply means is operable to pulse the flow of high pressure air to said purge air inlet of said manifold block.

9. An electrostatic powder coating system for selectively spraying any one of a plurality of different pulverant powder materials from a common spray gun, which system comprises a spray gun having a spray material flow passage terminating in an outlet orifice, means including a high voltage power supply for applying an electrical charge to powder material emitted from said spray gun, a plurality of powder material reservoirs, a manifold block having multiple powder inlet ports, an outlet port, and flow passages interconnecting said powder inlet ports to said outlet port, a plurality of first conduit means connecting each of said plurality of powder material reservoirs to one of said inlet ports of said manifold block, each of said first conduit means including a pneumatic conveyer line connected to one of said manifold block inlet ports, a powder flow passage extending between and interconnecting each of said pneumatic conveyer lines to an outlet of one of said reservoirs, a venturi pump contained within each of said pneumatic conveyer lines, and a pinch valve means contained within each of said powder flow passages between the reservoir and the venturi pump, second conduit means connecting said outlet port of said manifold block to said flow passage of said spray gun, multiple pinch valve means located in the manifold block flow passages and operable to control the flow of powder from each of said powder inlet ports to said outlet port, and control means for selectively activating said pinch valve means to control the choice of powder flowing to said outlet of said manifold and consequently to said spray gun.

10. An electrostatic powder coating system for selectively spraying any one of a plurality of different pulverant powder materials from a common spray gun, which system comprises a spray gun having a spray material flow passage terminating in an outlet orifice, means including a high voltage power supply for applying an electrical charge to powder material emitted from said spray gun, a plurality of powder material reservoirs, a manifold block having multiple powder inlet ports, an air purge inlet port, and outlet port, and flow passages interconnecting said powder and air purge inlet ports to said outlet port, first conduit means connecting each of said plurality of powder material reservoirs to one of said powder inlet ports of said manifold block, second conduit means connecting said outlet port of said manifold block to said flow passage of said spray gun, a source of air pressure connected to said air purge inlet of said manifold block so as to enable said spray gun and second conduit means to be purged of powder before initiation of a spray cycle of a new powder, said source of air pressure including air pressure supply means for initially supplying air at a first low pressure to said purge air inlet of said manifold block and for thereafter increasing the pressure of air supplied to said purge air inlet to a subsequent high pressure at least twice as great as the initial low pressure, and said air pressure supply means being operable to pulse the flow of high pressure air to said purge air inlet of said manifold block.

11. An electrostatic powder coating system for selectively spraying any one of a plurality of different pulverant powder materials from a common spray gun, which system comprises a spray gun having a spray material flow passage terminating in an outlet orifice, means including a high voltage power supply for applying an electrical charge to powder material emitted from said spray gun, a plurality of spray material reservoirs, a manifold block having multiple powder inlet ports, an air purge inlet port, an outlet port, and flow passages interconnecting said powder and air purge inlet ports to said outlet port, said flow passages comprising a central passage interconnecting said air purge inlet port to said outlet port and transverse passages interconnecting said powder inlet port to said central passage, said transverse passages intersecting said central passage on opposite sides of said central passage and at an obtuse angle partially directed at said outlet port, the intersections of said transverse passages and central passage on opposite sides of said central passage being longitudinally staggered so that powder directed through one of said transverse passages is not directed into a transverse passage located on the opposite side of the central passage, first conduit means connecting each of said plurality of spray material reservoirs to one of said powder inlet ports of said manifold block, second conduit means connecting said outlet port of said manifold block to said flow passage of said spray gun, a source of air pressure connected to said air purge inlet of said manifold block so as to enable said spray gun and second conduit means to be purged of powder before initiation of a spray cycle of a new powder, and pinch valves located in each of said transverse passages of said manifold block.

12. An electrostatic spraying system for spraying solid particulate powder material comprising a reservoir having a discharge opening through which powder material may flow outwardly from said reservoir, a pneumatic conveyer line, a flow passage extending between and interconnecting said pneumatic conveyer line and said reservoir discharge opening, said pneumatic conveyer line including means for creating a region of substantial vacuum in the area of intersection of said pneumatic conveyer line with said flow passage whereby powder material may be drawn through said flow passage into said pneumatic conveyer by the vacuum created in said region, electrostatic spray means in fluid communication with said pneumatic conveyer line, means for supplying gas at a pressure above that of the atmosphere to said pneumatic conveyer line, and means for preventing puffing of powder upon initiation of a spray cycle, said puffing prevention means comprising a pinch valve located in said flow passage between said pneumatic conveyer line and said reservoir discharge opening, and control means for causing said pinch valve to be opened simultaneously with or subsequently to the start of gas flow in said pneumatic conveyer line upon initiation of a spray cycle.

13. An electrostatic powder coating system for selectively spraying any one of a plurality of different color pulverant powder materials from a common spray gun, which system comprises a spray gun having a spray material flow passage terminating in an outlet orifice, means including a high voltage power supply for applying an electrical charge to powder material emitted from said spray gun, a plurality of powder material reservoirs, a manifold block having a purge air inlet port, multiple powder inlet ports, an outlet port, and flow passages interconnecting said inlet ports to said outlet port, a source of air under pressure greater than atmospheric pressure, means connecting said air source to said purge in inlet port of said manifold block, first conduit means including a pump and a flow control valve connecting each of said plurality of powder material reservoirs to one of said inlet ports of said manifold block, each of said flow control valves being located between the pump and the reservoir so as to control flow of powder to said pump, and second conduit means connecting said outlet port of said manifold block to said flow passage of said spray gun, control means for effecting the following sequence of operations to effect a color change of powder ejected from said spray gun:

(a) actuating a first pump and opening a first flow control valve so as to cause powder from a first reservoir to be directed through said manifold block to said spray gun;

(b) closing said first valve to cut off the flow of powder from said first reservoir to said first pump while continuing to operate said first pump for at least one second;

(c) directing a first low pressure purge flow of air from said source of air through said manifold and through said spray gun;

(d) subsequently directing a hard purge of high pressure air from said source in a pulsed flow through said manifold and said spray gun;

(e) actuating a second pump associated with a second powder reservoir, and (f) actuating a second flow control valve located between said second pump and said second reservoir so as to open the flow of powder material from said second reservoir to said second pump simultaneously with or subsequent to actuating of said second pump.

* * * * *